US006849138B1

(12) United States Patent
Kamiyama et al.

(10) Patent No.: US 6,849,138 B1
(45) Date of Patent: Feb. 1, 2005

(54) METHOD FOR SURFACE TREATMENT OF ALUMINUM ALLOY HIGH-TEMPERATURE PROCESSED ARTICLES

(75) Inventors: Shiro Kamiyama, Saitama (JP); Masanori Kosugi, Saitama (JP); Masahiro Kurata, Tokyo (JP); Sadao Shiraishi, Tokyo (JP); Michio Kobayashi, Tokyo (JP)

(73) Assignees: Honda Giken Kogyo Kabushiki Kaisha, Tokyo (JP); Sky Aluminium Co., Ltd., Tokyo (JP)

( * ) Notice: Subject to any disclaimer, the term of this patent is extended or adjusted under 35 U.S.C. 154(b) by 1826 days.

(21) Appl. No.: 08/174,957

(22) Filed: Dec. 28, 1993

(51) Int. Cl.[7] ..... C23C 22/00

(52) U.S. Cl. ..... 148/275; 148/264; 148/285; 205/213

(58) Field of Search ..... 205/213, 229, 205/227; 148/264, 265, 275, 285

(56) References Cited

U.S. PATENT DOCUMENTS

| | | | | | |
|---|---|---|---|---|---|
| 3,655,467 | A | * | 4/1972 | Sopp, Jr. | 156/22 |
| 4,476,658 | A | * | 10/1984 | Johnstone | 52/395 |
| 4,778,533 | A | * | 10/1988 | Gregory et al. | 134/29 |
| 5,055,257 | A | * | 10/1991 | Chakrabarti et al. | 148/564 |
| 5,104,465 | A | * | 4/1992 | McAuliffe et al. | 148/439 |

FOREIGN PATENT DOCUMENTS

| | | |
|---|---|---|
| JP | 50/86540 | 11/1975 |
| JP | 58-187258 A | 11/1983 |
| JP | 64/34731 | 2/1989 |
| JP | 1/212775 | 8/1989 |
| JP | 2/97700 | 10/1990 |

OTHER PUBLICATIONS

F. A. Lowenheim, Electroplating, McGraw–Hill Book Co., New York, 1978, pp 89.*

Julius Grant, editor, Hackh's Chemical Dictionary, fourth edition, MrGraw–Hill, Book Co., New York, 1969, pp 31.*

F.A. Lowenheim, *Electroplating,* McGraw–Hill Book Co., New York, 1978, pp 74–77, 89–91 and 463–467.*

* cited by examiner

*Primary Examiner*—Roy King
*Assistant Examiner*—William T. Leader
(74) *Attorney, Agent, or Firm*—Burns, Doane, Swecker & Mathis, L.L.P.

(57) ABSTRACT

The surface of an aluminum alloy high-temperature processed article containing Mg is heated at a high temperature of 200° C. or above, thereafter the surface is etched with an aqueous solution containing a chelating agent, and then at least one surface treatment selected from hydration oxidation treatment, coating type chromating, coating, anodizing, and alternating current electrolysis in an aqueous alkali solution is further carried out.

This method can provide a surface-treated aluminum alloy high-temperature processed article having superior anticorrosion and adhesion of coatings and a good surface appearance, and is effective as a pretreatment for further surface treatment.

11 Claims, 1 Drawing Sheet

METHOD FOR SURFACE TREATMENT OF ALUMINUM ALLOY HIGH-TEMPERATURE PROCESSED ARTICLES

BACKGROUND OF THE INVENTION

1. Field of the Invention

This invention relates to a surface treatment method for treating the surface of an aluminum alloy containing, e.g., 2.0% (by weight; the same applies hereinafter) or more of Mg and having been processed at a high temperature, to thereby obtain surface-treated aluminum alloy high-temperature processed articles as exemplified by construction materials, transport machinery materials, ornamentals, vessels and so forth having a good anticorrosion, a good adhesion of coatings and a beautiful surface appearance.

2. Description of Related Art

Aluminum high-temperature processed articles as exemplified by superplastic processed articles have been not feasible for uses that require beauty, adhesion of coatings and anticorrosion, for the following reasons.

In the case of processed articles of superplastic materials whose surfaces have been clad with pure aluminum as in SUPRAL100 (trade name; available from Alcan Co.), there are some examples in which the processed articles are used after surface treatment with relatively small problem. However, since they are clad materials, a cost increase can not be avoided.

In general, in such instances, it can be contemplated that adhesion of coatings and anticorrosion can be improved by mechanically removing surface layers through, e.g., air blast using alundum or the like as an abrasive. This method, however, tends to cause warpage and strain, and, because of the abrasive that may be buried in the surfaces, may cause blackening, poor adhesion of coatings and so forth after further surface treatment such as coating.

It can be also contemplated to use the known melons as disclosed in the following publications. There, however, are problems also set forth below together.

Japanese Patent Laid-open No. 50-86540:

This discloses that an aluminum substrate is treated with an aqueous alkali silicate solution, and thereafter treated with a vinylidene chloride resin to form an anticorrosive coating.

This method has the problem that the treatment tends to become uneven when the treatment with an alkali silicate is applied, making it difficult to obtain homogeneous coatings.

Japanese Patent Laid-open No. 4-04781:

This discloses that an aluminum sheet surface is degreased with a weak alkali and thereafter treated in an aqueous solution containing an oxidizing agent to form a boehmite costing.

This method has the problem that defective coatings and blackening may occur during boehmite treatment and coating treatment.

Japanese Patent Laid-open No. 1-212775:

This discloses that etching is carried out in an aqueous acidic solution of pH 2 or leas containing chloride ions, followed by etching in an aqueous alkaline solution of pH 13 or more.

This method has the problem that it requires two-stage treatment, which makes productivity poor to cause a cost increase. Moreover, because of occurrence of smuts, difficulties such as defective coatings may be caused in the subsequent coating and chemical conversion.

Japanese Patent Laid-open No. 2-97700:

This discloses that degreasing is applied in an aqueous solution to which a surface active agent has been added, and thereafter anodic polarization electrolysis and cathodic polarization electrolysis are alternately carried out.

This method has the problem that an uneveness may be caused during electrolysis in the aqueous surface active agent solution, and, in an attempt to obtain uniform treated surfaces, electric power is required in a large quantity, leading to a cost increase. In addition, this method can not be applied to articles having complicated shapes.

On the surface of aluminum alloy processed at a high temperature of 200° C. or above, an oxide layer is formed. In this oxide layer, a number of cracks are present, and the cracks cause a lowering of anticorrosion. The thickness thereof is also non-uniform. When processed at a high temperature as in the present invention, the material way undergo deformation and oxide layer formation at the same time, so that the layer becomes partly thick and partly thin. Accordingly, in order to obtain a good anticorrosion, a uniform and dense coating must be formed so that the disadvantages of the natural oxide layer can be compensated.

In the present invention, an aluminum alloy containing, e.g., 2% or more of Mg is used. The Mg tends to segregate on the surface of aluminum, and any presence of an oxide layer on the surface further promotes the tendency of segregation. The Mg having segregated on the surface forms magnesium oxide by its reaction with oxygen in the atmosphere. The magnesium oxide is alkaline, and adversely affect the anticorrosion, adhesion of coatings and surface appearance. Hence, it is necessary to eliminate the influence of Mg on the surface or in the vicinity of the surface.

SUMMARY OF THE INVENTION

An object of the present invention is to provide a method for treating the surface of an aluminum alloy high-temperature processed article by removing the surface oxide layer formed during high-temperature processing and the Mg having segregated on the surface or in the vicinity of the surface, which method can improve anticorrosion and adhesion of coatings and can promise a cost reduction.

The present invention provides a method for treating the surface of an aluminum alloy high-temperature processed article, comprising heating an aluminum alloy containing Mg at a high temperature of 200° C. or above, etching its surface with an aqueous solution containing a chelating agent, and then carrying out at least one surface treatment selected from hydration oxidation treatment, coating type chromating, coating, anodizing, and alternating current electrolysis in an aqueous alkali solution.

DESCRIPTION OF THE PREFERRED EMBODIMENTS

The aluminum alloy used in the present invention, containing 2.0% or more of Mg may also contain, besides the Mg, not more then 2% of Cu, not more than 2% of Mn, not more than 1% of Cr, not more than 1% of Zr, not more than 1% of Si, not more than 1% of Fe, not more then 1% of V, not more than 2% of Zn, not more than 0.1 of Ti, not more than 0.05% of B, not more than 0.5% of Be and not more then 0.05 each of other elements for the purposes of making crystals finer, improving superplastic moldability and strength and preventing oxidation, or as impurities.

The high-temperature processing at 200° C. or above herein referes to superplastic processing and hot processing. The technical problems as discussed in the present invention are not caused in usual cold processing carried out at temperatures lower than this temperature.

After the high-temperature processing has been carried out, the processed material is etched with an aqueous solution containing a chelating agent, and thereafter at least one surface treatment selected from hydration oxidation treatment, coating type chromating, coating, anodizing, and alternating current electrolysis in an aqueous alkali solution is carried out, so that a high-temperature processed article with excellent anticorrosion and adhesion of coatings can be obtained at a low cost.

The etching is carried out in order to remove oxide layers, surface Mg and release agents.

Stated specifically, after the aluminum alloy containing 2.0% or more of Mg has been heated at a high temperature of 200° C. or above, its surface is etched with the aqueous solution containing a chelating agent, and thereafter at least one surface treatment selected from hydration oxidation treatment, coating type chromating, coating, anodizing, and alternating current electrolysis in an aqueous alkali solution is carried out.

The etching by the use of the aqueous solution containing a chelating agent (the etching solution) causes no smuts to adhere to the surface and hence no desmutting is required, so that the process can be shortened.

This treatment may be carried out by either dipping or spraying.

The chelating scent may include aminopolycaroxylic acids such as EDTA (ethylenediaminetetraacetic acid) or alkali metal salts thereof, and alkali metal salts of aminocarboxylic acids such as picolinic acid. The chelating agent may be in a concentration of 0.005 mol/lit. or more, and preferably from 0.005 mol/lit to 0.5 mol/lit. Its use in a concentration less than 0.005 mol/lit. may make the effect of the chelating agent unsatisfactory, so that the oxide layer may remain to cause blackening, a poor adhesion and a poor anticorrosion after the surface treatment. Smuts also tend to occur on the surface of the aluminum alloy material to make it necessary to provide the step of desmutting.

Figure 1:
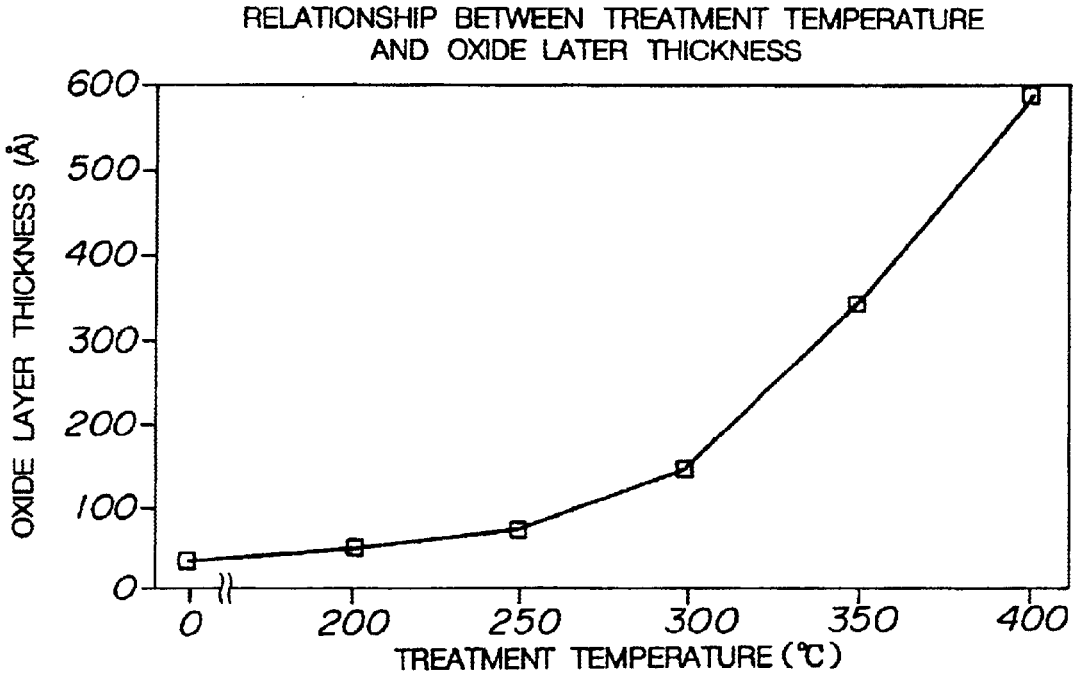
FIG. 1 is a graph to show the relationship between treatment temperature and oxide layer thickness.
Figure 2:
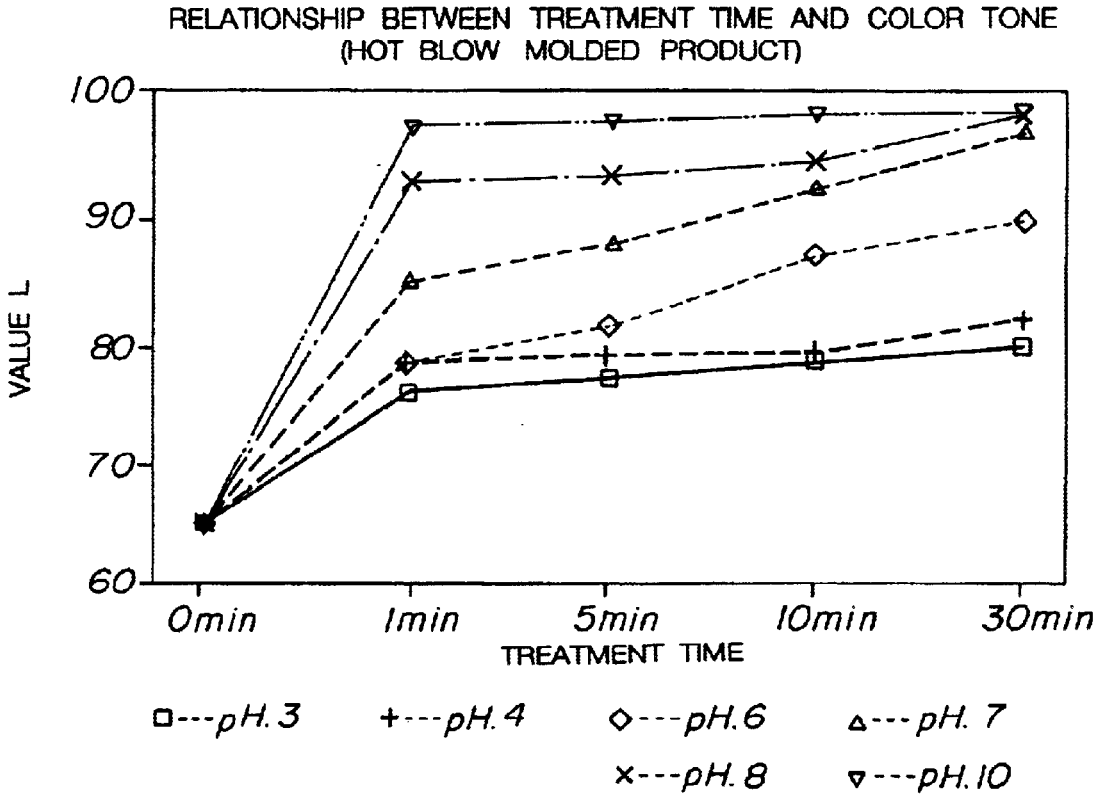
FIG. 2 is a graph to show the relationship between treatment time and color tone.

As shown in FIG. 1, the oxide layer thickness abruptly increases when treated at a temperature of 300° C. or above. There are no particular limitations on the pH of the etching solution. However, as shown in FIG. 2, the etching for increasing the value L (psychometric lightness) must be carried out for a long time. Hence, the pH should preferably be 7 or more.

In addition to the chelating agent, the etching solution may also contain an alkaline substance as exemplified by an alkali metal hydroxide such as sodium hydroxide or potassium hydroxide or an alkaline earth metal hydroxide such an calcium hydroxide, an amine compound such as triethenolamine, an alkali metal salt of phosphoric acid or polyphosphoric acid, or a polyamine compound such as ethylenediamine, or an acidic substance as exemplified by a mineral acid such as hydrochloric acid or a carboxylic acid such as citric acid. It may still also contain a surface active agent such as a nonionic surface active agent.

The etching may be carried out at a temperature of from room temperature to the boiling point, and there are no particular limitations. The temperature may be appropriately selected according to the relationship between the quantity of oxide layers of samples and the treating time. In view of treating time and handling properties, the etching may preferably be carried out at from about 40° C. to about 90° C. The treatment time my be from several seconds (e.g., 3 seconds) to about 30 minutes. It may be appropriately set taking account of the concentration of the solution, the temperature, the pH and the quantity of oxide layers.

The etching described above is a subbing treatment to the last. When the treated materials are actually formed into products such as construction materials, transport machinery materials, ornamentals, vessels and so forth, surface treatment such as coating and other treatment is carried out after the etching.

The surface treatment carried out after the etching will be described below.

The surface treatment after the etching may first include hydration oxidation treatment.

The hydration oxidation treatment may be carried out, without any particular limitations, by dipping the treated material in, or spraying it with, deionized water of 50° C. or above. The deionized water may contain the oxidizing agent as disclosed in Japanese Patent Laid-open No. 59-211578. It may also contain the amino compound such as triethanolamine, as disclosed in Japanese Patent Laid-open No. 64-34731.

The treatment time way be appropriately selected according to the relationship between the treatment bath temperature, the required film thickness and so forth. In usual instances, it may be set in the range of from about 1 minute to about 60 minutes.

The deionized water may have a DH of from about 4 to about 11. A pH of less than 4 or more then 11 is undesirable since the film formation can be insufficient or no film can be formed.

In the case when this surface treatment is carried out on the aluminum alloy high-temperature processed article containing, e.g., 2% or more of Mg as in the present invention, the treating solution should preferably have the following composition, selected from the foregoing. That is, it is preferred to use water controlled to have 500 ppm or less of sulfuric acid radical ion concentration, 100 ppm or less of phosphoric acid radical ion concentration, 200 ppm or less of K, Na or the like alkali metal salt concentration and 200 ppm or less of Fe, Cu or the like heavy metal salt concentration, having a pH of 6 to 8 and having a bath temperature of from 80° C. to 100° C. If the pH in 4 or more or lose than 6, it takes a long time to form a coating. If the pH is more than 8 and 11 or less, formation of a coarse coating may result. It the bath temperature is lower than 800° C., the aluminum alloy may become unsatisfactory to cause a lowering or adhesion of coatings.

The surface treatment carried out after the etching may also include coating type chromating.

The coating type chromating may be carried out by conventional methods, using an aqueous solution containing $Cr^{6+}$or $Cr^{3+}$, which may also contain $SiO_2$, a resin such as polyacrylic acid, a Zr salt, a Ti salt or the like.

There are no particular limitations on its coating method, and the solution may be appropriately coated by roll coating, spraying or brushing.

The coating weight may also be selected according to the purpose, and may usually be set in the range of from about 0.1 $g/m^2$ to about 5 $g/m^2$.

In baking type chromating, baking may be applied as desired.

The surface treatment carried out after the etching may further include anodizing. The anodizing may be carried out by conventional methods, e.g., by electrolysis in an aqueous solution of sulfuric acid, oxalic acid, phosphoric acid, boric acid or the like.

The file thickness may be selected according to the purpose, and may be set in the range of from about 0.1 to about 30 $\mu$m.

The surface treatment carried out after the etching may still further include alternating current electrolysis in an aqueous alkaline solution.

This alternating current electrolysis in an aqueous alkaline solution may be carried out, for example, in an aqueous alkaline solution having a bath temperature of from 30 to 90° C., as disclosed in Japanese Patent Laid-open No. 63-258674 and Japanese Patent Laid-open No. 2-182900.

In the case when this surface treatment is carried out on the aluminum alloy high-temperature processed article containing, e.g., 2% or more of Mg as in the present invention, the treating should preferably be carried out under the following conditions, selected from the foregoing. That is, the electrolysis may preferably be carried out for a time of from 20 to 40 seconds and at a quantity of electricity of from 100 to 200 C/dm$^2$. If the electrolysis time is less than 20 seconds or the quantity of electricity is less than 100 C/dm$^2$, the film formation can be insufficient and formation of uneven coatings may result. If the electrolysis time is more than 40 seconds or the quantity of electricity is more than 100 C/dm$^2$, dusting may occur to cause a lowering of adhesion of coatings.

As stated above, defects such as cracks and MgO are present in a large number in the oxide layer formed during the high-temperature processing, and also lubricants or release agents used at the time of the high-temperature processing adhere to the coatings, so that coating properties such as adhesion of coatings become poor.

Such difficulties can be prevented by removing the oxide layers formed during the high-temperature processing and the release agents and so forth having adhered during the high-temperature processing, and thereafter covering the surface with a coating having a good anticorrosion and also having a good surface appearance.

In the present invention, after the aluminum alloy containing Mg has been heated at a high temperature of 200° C. or above, its surface is etched with the aqueous solution containing the chelating agent. This etching can;

1) remove the oxide layers formed, and the release agents having adhered, during the high-temperature processing, so that the adhesion of coatings and the anticorrosion can be improved; and
2) prevent part of the oxide layers from being incorporated at the time of the hydration oxidation treatment or anodizing, so that coatings having white (metallic gloss) beautiful surface appearance and having excellent aluminum alloy and adhesion of coatings can be formed.

For the surface treatment subsequent to the etching thus carried out, the etching is effective as follows:

The hydration oxidation treatment is carried out in the deionized water at a temperature of 50° C. or above so that a dense, stable end anticorrosive hydrated oxide film can be formed on the surface. Since —OH groups and —O groups are present on the surface of this coating, they combine with functional groups such as —COO groups, —OH group, ═O groups and —NHCO groups to form firm hydrogen bonds, so that the adhesion of coatings can be improved. The triethanolamine or the oxidizing agent promotes the formation of this hydrated oxide film, and hence its addition makes it possible to shorten the time required for the hydration oxidation treatment.

The anodizing and the alternating current electrolysis in an aqueous alkali solution are each a treatment carried out to form a dense and stable oxide film on the surface so that the anticorrosion can be improved. On the surface of the oxide film formed by this treatment, reactive functional groups such as —OH groups and —O groups like those of the hydrated oxide film are present, and hence they act cooperatively with functional groups possessed by coating materials to bring about an improvement in the adhesion of coatings.

The coating type chromating is carried out to form a chromate film, and a high anticorrosion can be obtained. Chromate ions and functional groups of the coating film can also cooperatively act to bring about an improvement in the adhesion of coatings. In addition, since a treatment such as washing after coating is unnecessary, the present method can be applied also to articles having complicated shapes, and yet can be inexpensive.

EXAMPLES

The present invention will be described below in greater detail by giving Examples.

Example 1

Superplastic materials (sheet thickness: 1.6 mm) comprised of Al-4% Mg-1% Mn-0.005% B were maintained at 500° C. for 10 minutes, and thereafter processed by plastic blow molding at 5 MPa in the atmosphere.

The resulting high-temperature processed sheets were left to naturally cool, and then each etched using an aqueous solution containing a chelating agent and under conditions as shown in Table 1, followed by washing with water and then drying.

Thereafter, the subsequent surface treatment as shown in Table 1 was carried out.

The surface-treated materials thus obtained were subjected to an SST test (salt spray test) according to JIS Z2731-1988 for 2,000 hours.

A tape adhesion test was also carried out by sticking 18 mm wide Sekisui Polyester Tape No. 21 on the surface, and a peel strength at 90° C. was measured.

The surface appearance was also visually evaluated.

Results obtained are shown in Table 1.

The subsequent surface treatments were carried out under the following conditions.

(I) Hydration oxidation treatment (1):

Pure water: immersed at 90° C. for 5 minutes.

(II) Hydration oxidation treatment (2):

An aqueous solution containing 100 g/lit. of 1-triethanolamine; immersed at 90° C. for 1 minute.

(III) Anodizing:

15% by weight of sulfuric acid; 20° C.; current density: 1.5 $\lambda$/dm$^2$; electrolysis time; 10 minutes.

(IV) Coating type chromating:

A chromate treating agent was coated, followed by natural drying. Dried coating weight: 1 g/m$^2$.

(V) Alkali alternating current electrolysis:

Sodium phosphate electrolytic solution; pH: 10.5; 70° C.; electrolysis time: 30 minutes.

The above (I) to (V) corresponds to those in Table 1.

In Table 1, TEA is an abbreviation for triethanolamine. The pH values shown in the table are values read on a pH meter.

Comparative Example 1

Example 1 was repeated except that the etching using the aqueous solution containing a chelating agent was not carried out after the superplastic blow molding and cooling.

Results obtained are shown in Table 1.

TABLE 1

| Etching | | | | | Anti- | | |
|---|---|---|---|---|---|---|---|
| EDTA conc. (mol/l) | TEA conc. (g/l) | Temp. (° C.) | Time (min) | Surface treatment | corrosion* (%) | Peel strength (N/cm$^2$) | Appearance |
| Example 1: | | | | | | | |
| 0.02 | 100 | 60 | 1 | (I) | 0.05 | 12 | Good |
| 0.04 | 100 | 90 | 1 | (II) | 0.05 | 11 | Good |
| 0.10 | 40 | 90 | 2 | (III) | 0.1 | 12 | Good |
| 0.20 | 100 | 40 | 10 | (IV) | 0.1 | 8 | Good |
| 0.10 | 0 | 90 | 5 | (V) | 0.5 | 14 | Good |
| Comparative Example 1: | | | | | | | |
| No etching | | | | (I) | 12 | 5 | Black |
| No etching | | | | (II) | 12 | 4 | Black |
| No etching | | | | (III) | 15 | 5 | Black |
| No etching | | | | (IV) | 10 | 3 | Uneven |
| No etching | | | | (V) | 7 | 6 | Gray |

*(Corrosion area)

As is seen from Table 1, Example 1 in which the etching is carried out using the aqueous solution containing the chelating agent of the present invention and thereafter the further surface treatment is carried out shows superior results all on the anticorrosion, the peel strength and the surface appearance, compared with Comparative Example 1 in which no etching was carried out before the further surface treatment.

As is clear from the foregoing description, the method of the present invention for the surface treatment of the aluminum alloy high-temperature processed article can obtain superior results all in the anticorrosion, the adhesion of coatings and the surface appearance, and the resulting products can be preferably used in construction materials, transport machinery materials, ornamentals, vessels and so forth.

What is claimed is:

1. A method for treating the surface of an aluminum alloy high-temperature processed article, comprising heating an aluminum alloy containing Mg at a high temperature of 200° C. or above, etching the surface by a single step process of exposing the surface to an aqueous solution containing a chelating agent wherein the aqueous solution consists of a solution having a pH of 7 or higher, and then carrying out hydration oxidation treatment.

2. The method according to claim 1, wherein said chelating agent is selected from the group consisting of ethylenediaminetetraacetic acid or an alkali metal salt thereof and an alkali metal salt of picolinic acid.

3. The method according to claim 2, wherein said chelating agent is disodium ethylenediaminetetraacetate.

4. The method according to claim 1, wherein said chelating agent is in a concentration of 0.005 mol/lit.

5. The method according to claim 1, wherein said chelating agent is in a concentration of from 0.005 mol/lit to 0.5 mol/lit.

6. The method according to claim 1, wherein said aqueous solution further contains an amine compound.

7. The method according to claim 6, wherein said amine compound is triethanolamine.

8. The method according to claim 1, wherein said etching is carried out at a temperature of from 40° C. to 90° C. for 3 seconds to 30 minutes.

9. The method according to claim 1, wherein said Mg is in a content of 2% by weight or more.

10. The method according to claim 1, wherein said Mg is in a content of 2% by weight or more, and said hydration oxidation treatment is carried out using a treating solution having 500 ppm or less of sulfuric acid radical ion concentration, 100 ppm or less of phosphoric acid radical ion concentration, 200 ppm or less of an alkali metal salt concentration and 200 ppm or less of a heavy metal salt concentration, has a pH of 6 to 8 and has a bath temperature of from 80° C. to 100° C.

11. The method according to claim 1, wherein the article thus surface-treated is post-treated by coating.

* * * * *